US007731337B2

(12) United States Patent
Kang et al.

(10) Patent No.: US 7,731,337 B2
(45) Date of Patent: Jun. 8, 2010

(54) HIGH EFFICIENCY HEATING RESISTOR COMPRISING AN OXIDE, LIQUID EJECTING HEAD AND APPARATUS USING THE SAME

(75) Inventors: Sang-Won Kang, Daejeon (KR); Se-Hun Kwon, Gyeonggi-do (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 693 days.

(21) Appl. No.: 11/656,555

(22) Filed: Jan. 23, 2007

(65) Prior Publication Data

US 2008/0158303 A1 Jul. 3, 2008

(30) Foreign Application Priority Data

Jan. 3, 2007 (KR) ..... 10-2007-0000754

(51) Int. Cl.
*B41J 2/05* (2006.01)

(52) U.S. Cl. ..... 347/62

(58) Field of Classification Search ..... 347/55, 347/61, 62

See application file for complete search history.

(56) References Cited

U.S. PATENT DOCUMENTS

| | | | | |
|---|---|---|---|---|
| 3,852,563 | A | 12/1974 | Bohorquez et al. | |
| 4,513,298 | A | 4/1985 | Scheu | |
| 4,532,530 | A | 7/1985 | Hawkins | |
| 4,965,611 | A | 10/1990 | Pan et al. | |
| 5,870,121 | A | 2/1999 | Chan | |
| 6,013,160 | A | 1/2000 | Raisanen et al. | |
| 6,375,312 | B1 | 4/2002 | Ikeda et al. | |
| 6,382,775 | B1 | 5/2002 | Kubota et al. | |
| 6,395,148 | B1 | 5/2002 | Whitman | |
| 6,527,813 | B1 | 3/2003 | Saito et al. | |
| 7,165,830 | B2 * | 1/2007 | Miller, Jr. | 347/64 |

FOREIGN PATENT DOCUMENTS

KR 10-0223978 7/1999

OTHER PUBLICATIONS

English language abstract of KR 10-0223978 B1 (1999) Korean Patent Abstracts (listed on accompanying PTO/SB/08A as document FP1).

Aden, J. S. et al., "The Third-Generation HP Thermal InkJet Printhead," *Hewlett-Packard Journal 45*:41-45 (1994) Hewlett-Packard Co.

Cuong, N. D. et al., "Characterization of Tantalum Nitride Thin Films Deposited on $SiO_2$/Si Substrates Using dc Magnetron Sputtering for Thin Film Resistors," *J. Electrochem. Soc. 153*:G164-G167 (Jan. 2006) The Electrochemical Society.

Eldridge, J. M. et al., "Various Properties of Sputter-Deposited $HfB_2$ Films," *J. Electrochem. Soc. 137*:3905-09 (1990) The Electrochemical Society.

(Continued)

*Primary Examiner*—An H Do

(74) *Attorney, Agent, or Firm*—Sterne, Kessler, Goldstein and Fox P.L.L.C.

(57) ABSTRACT

The present invention is directed to a heating resistor including a conducting oxide having an electric conductivity and a nonconducting oxide having insulation or nonconductivity, liquid ejecting heads and apparatus comprising the heating resistors.

12 Claims, 8 Drawing Sheets

OTHER PUBLICATIONS

Jia, Q. X. et al., "On the nature of zero temperature coefficient of resistance of $RuO_2$ thin film resistor formation using in situ annealing," *J. Vac. Sci. Technol. A 11*:1052-55 (1993) American Vacuum Society.
Kim, Y. T., "Achievement of zero temperature coefficient of resistance with $RuO_x$ thin film resistors," *Appl. Phys. Lett. 70*:209-11 (1997) American Institute of Physics.
Lim, J. et al., "Failure mechanisms in thermal inkjet printhead analyzed by experiments and numerical simulation," *Microelectronics Reliability 45*:473-78 (2005) Elsevier Ltd.
Saha, R. and Barnard, J. A., "Effect of structure on the mechanical properties of Ta and Ta(N) thin films prepared by reactive DC magnetron sputtering," *J. Cryst. Growth 174*:495-500 (1997) Elsevier Science B.V.
Wu, Y. and Chiu, S., "Effects of passivation layers on inkjet printhead," *SPIE 3422*:53-60 (1998) The International Society for Optical Engineering.
Wuu, D. S., et al., "Characterization of hafnium diboride thin film resistors by r.f. magnetron sputtering," *Mater. Chem. Phys. 45*:163-66 (1996) Elsevier Science S.A.

* cited by examiner

Nano-Crystal Embedded Structure

Inter-mixed Structure

Laminated Structure

HIGH EFFICIENCY HEATING RESISTOR COMPRISING AN OXIDE, LIQUID EJECTING HEAD AND APPARATUS USING THE SAME

CROSS-REFERENCE TO RELATED APPLICATIONS

This application claims priority to Korean Patent Application No. 10-2007-0000754, filed Jan. 3, 2007, which is incorporated by reference herein in its entirety.

BACKGROUND OF THE INVENTION

1. Field of the Invention

The present invention is directed to heating resistors comprising a conducting oxide and a nonconducting oxide and liquid ejecting heads and other devices comprising the heating resistors.

2. Background Art

FIG. 1 provides a schematic representation of the process of liquid ejection from a conventional representative liquid ejecting head. The process of liquid ejecting included the following steps: i) a heating resistor is heated by applying an electric signal to the exterior of the heating resistor, thereby temporarily heating an adjoining printing liquid above a boiling point of the liquid to form bubble cores; ii) the bubble cores grow or coalesce to form a super bubble, and as a result the printing liquid fills the chamber of the liquid ejecting head and becomes pressurized; iii) the printing liquid in the vicinity of a nozzle or outlet is dispensed to the outside of the chamber in the shape of a droplet, and the supper bubble collapses; and iv) the printing chamber is recharged with additional printing liquid via a capillary vessel. During the ink-dispensing process collapse of the super bubbles causes a strong pressure to be locally applied to the surface of the heating resistor, the pressure being called a cavitation force. The cavitation force can create defects in the heating resistor and may be a reason for a reduced lifetime observed in many printing devices that operate by this process of liquid ejection (see, e.g., Aden, J. S. et al., "The Third-Generation HP Thermal InkJet Printhead," *Hewlett-Packard Journal* 45:41-45 (1994) and Lim, J. et al., "Failure mechanisms in thermal inkjet printhead analyzed by experiments and numerical simulation," *Microelectronics Reliability* 45:473-478 (2005)).

FIG. 2 provides a schematic cross-sectional view of the major parts of a conventional substrate used in a liquid ejecting head. Referring to FIG. 2, the conventional liquid ejecting typically comprises a silicon substrate (201) having deposited thereon a plurality of layers that provide a driving circuit and a heating resistor. The heating resistor (203) heats a printing liquid when an electrical signal is applied to the heating resistor by an electrode (204). Typically, an insulating layer (202) is formed between the silicon substrate (201) and heating resistor (203) to provide thermal and electric insulation between the heating resistor (203) and the silicon substrate (201). A patterned electrode layer (204) is formed adjacent to the heating resistor (203) and applies an electric signal to the heating resistor. The electrode layer typically comprises a metal conductor. Protection layers (205, 206) are formed on the surface of the electrode (204) and heating resistor (203) to protect the electronically active elements from chemical and/or mechanical damage associated with thermal cycling of the heating resistor (203) and also to electrically insulate the heating resistor (203) and electrode layer (204) from the printing liquid.

In general, the heating resistor should have the following properties:

(1) a controlled electrical resistivity within a proper scope to be applied to liquid ejecting systems;

(2) a low temperature coefficient of resistance (TCR) so that the change of the electrical resistance in accordance with a temperature is minimized; and (3) chemical, mechanical and electrical stability during thermal cycling.

Materials for use in heating resistors for liquid ejecting head that have been conventionally used include: $HfB_2$ (U.S. Pat. Nos. 6,375,312 and 6,013,160), TaAl (U.S. Pat. Nos. 3,852,563, 4,513,298 and 4,965,611), poly-Si (U.S. Pat. No. 4,532,530), $Ti/TiN_x$ (U.S. Pat. No. 5,870,121), $\alpha$-Ta (U.S. Pat. No. 6,395,148), $TaN_{0.8}$ (Korean patent laid-open publication 10-1994-0014946 and U.S. Pat. Nos. 6,375,312 and 6,382,775), and TaSiN (U.S. Pat. No. 6,527,813). However, these materials can exhibit degradation during thermal cycling. Moreover, no other materials complying with the above requirements except the conventional materials have been reported. Therefore, what is needed are new materials for use in thermal resistor elements and ink ejecting devices that integrate these new materials to enable the manufacture of printing devices having longer lifetimes and greater reliability.

BRIEF SUMMARY OF THE INVENTION

The present invention is directed to new materials for use as a heating resistor. According to the present invention, it is possible to satisfy basic material characteristics as well as easily control the electric resistivity across a wide resistivity range, resulting in the ability to freely design the physical dimensions (i.e., length, width, thickness, etc.) of a heating resistor for use in an ink ejecting device. The materials and heating resistor of the present invention are especially useful for improving the efficiency of heat transfer between a heating resistor and a printing liquid, resulting in higher printing speed and better resolution, as well as a longer device lifetime and more reliable printing head.

A heating resistor comprising a conductive oxide and a nonconducting oxide according to the present invention is especially useful in a liquid ejecting system for dispensing a printing liquid onto media such as, but not limited to, paper, synthetic paper and fiber. The heating resistor comprising of the present invention can be applied to output devices such as, but not limited to, inkjet printers, facsimile devices, copying machines, and combination systems thereof. Additionally, the heating resistor of the present invention can be applied to a lithography process as is used in semiconductor manufacturing, or forming wire elements in other electronic devices such as flat panel displays and the like. The liquid ejecting system of the present invention comprises a substrate having a heating resistor thereon, in combination with a liquid ejecting head, which can be interfaced with a liquid ejecting apparatus, referred to hereinafter as a liquid ejecting system.

The heating resistor of the present invention has a longer lifetime and is more reliable than conventional heating resistors. Moreover, the heating resistor of the present invention has an electrical resistivity that can be controlled over a broad range, and also has a low temperature coefficient of resistance (TCR) such that a change in device temperature does not appreciably change the electrical resistance of the thermal resistor, enabling printing devices that contain the heating resistors of the present invention to be used repeatedly over an extensive time with no change in device characteristics.

The present invention is also directed to a liquid ejecting system comprising a heating resistor comprising new materials.

The present invention is also directed to a high speed/high resolution liquid ejecting system having a strong resistance to the thermal oxidation reaction, an electrical and chemical stability at a high temperature and a good impact-resistance to mechanical impact, such that the heating resistor can be contacted directly a printing liquid without the presence of a protective layer, thereby improving the thermal resistance during heating of the printing liquid.

The present invention is also directed to a liquid ejecting system having a contact layer between the heating resistor and the electrode, wherein the electric contact resistance between these elements is minimized.

The present invention is also directed to a heating resistor comprising a conducting oxide ($AO_x$) having an electric conductivity and a nonconducting oxide ($BO_y$) having insulation or nonconductivity.

The present invention is also directed to a substrate for a liquid ejecting head, the substrate comprising: a silicon layer; a heating resistor deposited thereon, wherein the heating resistor comprises a conducting oxide ($AO_x$) having an electric conductivity and a nonconducting oxide ($BO_y$) having insulation or nonconductivity, wherein the heating resistor is capable of generating a thermal energy in response to an electric signal; and an electrode layer suitable for supplying an electric signal to the heating resistor.

The present invention is also directed to a liquid ejecting head comprising: the substrate of the present invention; a liquid ejecting head provided on the substrate; and a liquid supply passage disposed on the substrate suitable for supplying a liquid to the to the liquid ejecting head.

The present invention is also directed to a liquid ejecting head comprising: the substrate of claim of the present invention; a liquid ejecting head provided on the substrate; a liquid supply passage disposed on the substrate suitable for supplying a liquid to the to the liquid ejecting head; and an electrical signal supply means suitable for supplying an electric signal to the heating resistor.

In some embodiments, the conducting oxide ($AO_x$) comprises at least one material selected from the group consisting of: $RuO_x$, $PdO_x$, $IrO_x$, $PtO_x$, $OsO_x$, $RhO_x$, $ReO_x$, $ZnO_x$, $InO_x$, $SnO_x$, $PtRhO_x$, $SrRuO_3$, $In_{1-x}Sn_xO_3$, $Na_xW_{1-x}O_3$, $Zn_x(Al, Mn)_{1-x}O$, $La_{0.5}Sr_{0.5}CoO_3$, $CrSiO_x$, $Na_2Pt_3O_4$, $NiCrO_x$, $Bi_2Ru_2O_7$.

In some embodiments, the nonconducting oxide (BOy) comprises at least one material selected from the group consisting of: $AlO_y$, $TiO_y$, $TaO_y$, $HfO_y$, $BaO_y$, $VO_y$, $MoO_y$, $SrO_y$, $NbO_y$, $MgO_y$, $SiO_y$, $FeO_y$, $CrO_y$, $NiO_y$, $CuO_y$, $ZrO_y$, $BO_y$, $TeO_y$, $ZnO_y$, $BiO_y$, $WO_y$, $CdO_y$, $CoO_y$, $LaO_y$, $MgO_y$, $GaO_y$, $GeO_y$, $SrTiO_3$, $BaTiO_3$, $Al_xTi_{1-x}O_y$, $Hf_xSi_{1-x}O_y$, $HfxAl_{1-x}O_y$, $Hf_xAl_{1-x}O_y$, $Ti_xSi_{1-x}O_y$, $Ta_xSi_{1-x}O_y$, $LaTiO_3$, $ZnxTi_{1-x}O_y$.

In some embodiments, the heating resistor has a temperature coefficient of resistance (TCR) of about (+)500 ppm/K to (−)500 ppm/K.

In some embodiments, the heating resistor comprises a conducting oxide ($AO_x$) having a temperature coefficient of a resistance (TCR) of about (+)500 ppm/K to (−)500 ppm/K.

In some embodiments, the heating resistor has a resistivity of about 10 μΩ·cm to about 30,000 μΩ·cm and a thickness of about 20 Å to about 20,000 Å.

In some embodiments, the heating resistor has a structure selected from the group consisting of: a structure wherein the conducting oxide ($AO_x$) is present as a matrix and the nonconducting oxide ($BO_y$) is present as particles embedded in the matrix; a structure wherein the conducting oxide ($AO_x$) is completely mixed with the nonconducting oxide ($BO_y$) so that the conducting oxide and the nonconducting oxide cannot be distinguished; a structure wherein the conducting oxide ($AO_x$) and the nonconducting oxide ($BO_y$) are present as a layered structure; and combinations thereof.

In some embodiments, the substrate of the present invention further comprises: a contact layer located between the heating resistor and the electrode layer, wherein the contact layer comprises a material selected from the group consisting of: an elemental material (A) present in the conducting oxide ($AO_x$), a nitride of an elemental material (A) present in the conducting oxide ($AO_x$), an elemental material (A) present in the conducting oxide ($AO_x$) in combination with at least one of Ti, TiN, Ta, TaN, W, WN and WCN, and combinations thereof.

In some embodiments, the substrate of the present invention further comprises: a single or multilayered protection layer suitable for protecting the electrode layer and the heating resistor.

The other objects of the present invention will become more apparent through the embodiments of the present invention which now will be described. Further embodiments, features, and advantages of the present inventions, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate one or more embodiments of the present invention and, together with the description, further serve to explain the principles of the invention and to enable a person skilled in the pertinent art to make and use the invention. The above and other objects, features and advantages of the present invention will be more clearly understood from the following detailed description taken in conjunction with the accompanying drawings, in which.

Figure 1:
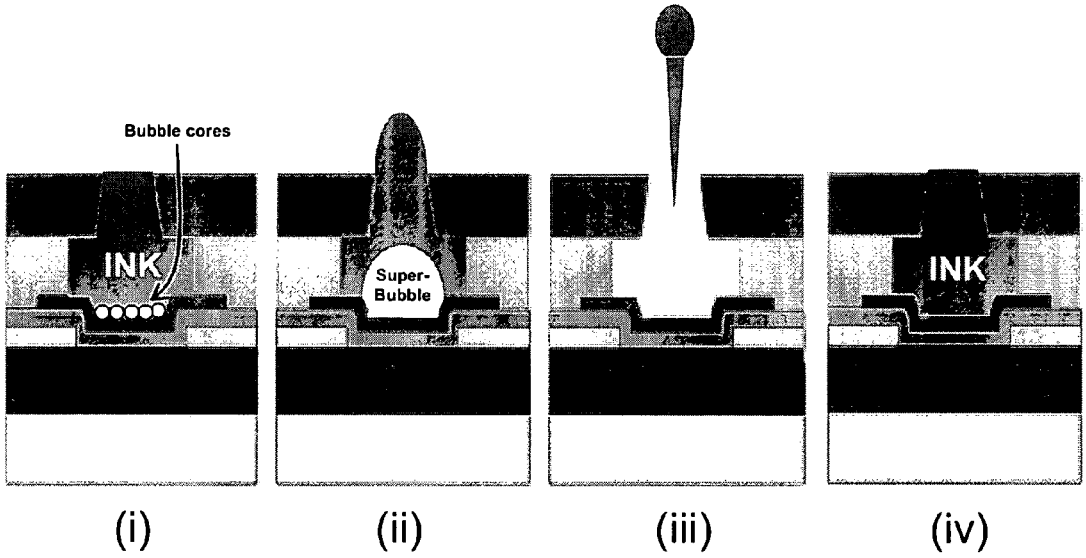
FIG. 1 is a schematic view for describing a principle of ejecting a liquid in the conventional representative liquid ejecting head.

One or more embodiments of the present invention will now be described with reference to the accompanying drawings. In the drawings, like reference numbers can indicate identical or functionally similar elements. Additionally, the left-most digit(s) of a reference number can identify the drawing in which the reference number first appears.

DETAILED DESCRIPTION OF THE INVENTION

This specification discloses one or more embodiments that incorporate the features of this invention. The disclosed embodiment(s) merely exemplify the invention. The scope of the invention is not limited to the disclosed embodiment(s). The invention is defined by the claims appended hereto.

The embodiment(s) described, and references in the specification to "one embodiment", "an embodiment", "an example embodiment", etc., indicate that the embodiment(s) described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

Before the configuration of the present invention is concretely described, if not mentioned in detail to the contrary, the specific dimensions and variables shown in the configuration of the present invention and the below embodiments are just provided as an example for obtaining the optimum results but are not set forth to limit the present invention. In addition, the specific chemical formula and component indications shown in the present invention are just provided as an example but are not set forth to limit the present invention, also. Furthermore, the present invention is not limited to the specific physical dimensions (length, width and thickness) and the shape of a heating resistor and the configurations of other layers of a liquid ejecting head and specific applied fields. In other words, the present invention relates to a new material for manufacturing a heating resistor and can be claimed with respect to all types of liquid ejecting system including a heating resistor consisting new materials according to the present invention.

In order to attain the first object of the present invention, a new material for manufacturing a heating resistor is a mixing material of a conducting oxide (represented as $AO_x$ in a chemical formula, hereinafter) and a nonconducting oxide (represented as $BO_y$ in chemical formula, hereinafter), which is represented by the formula ABO in general and by the chemical formula $(AO_x)_m$—$(BO_y)_n$ in concrete. The above-mentioned conducting oxide refers to a mixture of at least two kinds of metal or nonmetal oxides having an electric conductivity including a metal or a nonmetal series oxide having an electrical conductivity, hereinafter referred to as a conducting oxide in the present invention. In addition, the above-mentioned nonconducting oxide refers to a mixture of at least two kinds of metal or nonmetal oxides having an electric nonconductivity including a metal or a nonmetal series oxide having an electric nonconductivity, hereinafter referred to as a nonconducting oxide in the present invention.

In the above chemical formula, "A" refers to at least one metal or nonmetal atom configuring a conducting oxide, "B" refers to at least one metal or nonmetal atom configuring a nonconducting oxide and "O" refers to oxygen. If shown in the chemical formula of $(AO_x)_m$—$(BO_y)_n$, "x" and "y" are determined depending on the kinds of a metal or a nonmetal atom of "A" and "B", "m" and "n" represent a stoichiometric or mixing ratio of a conducting oxide ($AO_x$) and nonconducting oxide ($BO_y$) where m+n=100 mol %.

The heating resistor manufactured by mixing conducting oxide ($AO_x$) and nonconducting oxide ($BO_y$) suggested in the present invention has been already chemically combined with oxygen safely to have a characteristic in that the change of characteristics of a material due to a chemical and an electrical chemical reaction with the liquid for printing is minimized even if it is directly contacted with the liquid for printing to be ejected and dispensed at a high temperature for a long time. In addition, the conducting oxide ($AO_x$) is mixed with the nonconducting oxide ($BO_y$) to be used as a new material of a heating resistor and has advantages as below. First, if the conducting oxide is solely used as a material of a heating resistor, it has an excessively low resistivity and is not proper to be solely applied in a liquid ejecting system. Second, a resistivity can be easily controlled in accordance with a mixing ratio of the conducting oxide and the nonconducting oxide and it is advantageous in that the physical dimensions of a heating resistor can be variously designed in accordance with the request of a liquid ejecting system. For example, if the structure becomes minute in order to obtain a high resolution of the liquid ejecting system, a voltage decrease (voltage decrease due to current resistance) by a metal electrode provided in order to apply an electric signal to a heating resistor is increased. So as to minimize the effect of this voltage decrease, the resistance of a heating resistor should be maintained over a regular ratio. In case of the material constituting the existing heating resistor, it is difficult to change the resistivity owned by the material itself, it cannot help but increase the resistance of the heating resistor by decreasing the thickness of a thin film of the material or changing other physical dimensions. However, the method for decreasing the thickness of such thin film may become a reason to decrease a mechanical impact resistance of a heating resistor and the reliability. Moreover, the change of other physical dimensions of the heating resistor brings difficulties of limiting in designing a liquid ejecting system. In comparison, the resistivity of the heating resistor of the present invention can be tailored via the selection of reactants and process conditions, and can therefore advantageously avoid many of the above problems. Third, it is advantageous in improving the characteristics of a temperature coefficient of resistance (TCR) of the heating resistor in accordance with the selection and the mixing ratio and the mixing structure of the conducting oxides and the nonconducting oxides. Here, the mixing structure refers to a particle-embedded structure where the conducting oxide ($AO_x$) forms a matrix and the nonconducting oxide ($BO_y$) is distributed in the matrix in the form of particles or an intermixed structure where the conducting oxide ($AO_x$) is completely mixed with the nonconducting oxide ($BO_y$) not to be distinguished or a laminated-film structure where the conducting oxide ($AO_x$) and the nonconducting oxide (BOy) are reiterated to have a proper thickness.

The representative examples of conducting oxide ($AO_x$) and nonconducting oxide ($BO_y$) constituting new materials for manufacturing the above-described heating resistor are shown in the following Table 1.

TABLE 1

Conducting oxide ($AO_x$) and Nonconducting oxide ($BO_y$) materials suitable for use with the present invention.

| Conducting oxide ($AO_x$) | | Nonconducting oxide ($BO_y$) | | | |
|---|---|---|---|---|---|
| Binary oxide | Multi-element oxide | Binary oxide | | | Multi-element oxide |
| $RuO_x$ | $PtRhO_x$ | $AlO_y$ | $CuO_y$ | $CdO_y$ | $SrTiO_8$ |
| $PdO_x$ | $SrRuO_8$ | $TiO_y$ | $ZrO_y$ | $CoO_y$ | $BaTiO_8$ |
| $IrO_x$ | $In_{1-x}Sn_xO_8$ | $TaO_y$ | $BO_y$ | $LaO_y$ | $Al_xTi_{1-x}O_y$ |
| $PtO_x$ | $Na_xW_{1-x}O_8$ | $HfO_y$ | $TeO_y$ | $MgO_y$ | $Hf_xSi_{1-x}O_y$ |
| $OsO_x$ | $Zn_x(Al,Mn)_{1-x}O$ | $BaO_y$ | $ZnO_y$ | $GaO_y$ | $Hf_xAl_{1-x}O_y$ |
| $RhO_x$ | $La_{0.5}Sr_{0.5}CoO_8$ | $VO_y$ | $BiO_y$ | $GeO_y$ | $Hf_xAl_{1-x}O_y$ |
| $ReO_x$ | $CrSiO_x$ | $MoO_y$ | $SiO_x$ | $WO_y$ | $Ti_xSi_{1-x}O_y$ |
| $ZnO_x$ | $Na_2Pt_8O_4$ | $SrO_y$ | $FeO_y$ | $NiO_y$ | $Ta_xSi_{1-x}O_y$ |
| $InO_x$ | $NiCrO_x$ | $NbO_y$ | $CrO_y$ | $MgO_y$ | $LaTiO_8$ |
| $SnO_x$ | $Bi_2Ru_2O_7$ | | | | $Zn_xTi_{1-x}O_y$ |

In some embodiments, a conducting oxide ($AO_x$) of the present invention is a binary oxide comprising an oxide of a single metal or nonmetal such as, but not limited to, $RuO_x$, $PdO_x$, $IrO_x$, $PtO_x$, $OsO_x$, $RhO_x$, $ReO_x$, $ZnO_x$, $InO_x$, $SnO_x$, and the like. In some embodiments, a conducting oxide ($AO_x$) of the present invention is a ternary or multi-element oxide such as, but not limited to, $PtRhO_x$, $SrRuO_3$, $In_{1-x}Sn_xO_3$, $Na_xW_{1-x}O_3$, $Zn_x(Al, Mn)_{1-x}O$, $La_{0.5}Sr_{0.5}CoO_3$, $CrSiO_x$, $Na_2Pt_3O_4$, $NiCrO_x$, $Bi_2Ru_2O_7$, etc. In addition, the conducting oxide of the present invention can comprise a mixture of conducting oxides. That is, as described earlier, the conducting oxide ($AO_x$) of the present invention refers to mixtures of at least two kinds of a conducting metal or a nonconducting metal, including single or multi-element oxides with an electrical conductivity shown as above.

In some embodiments, the characteristics of a temperature coefficient of resistance (TCR) of the conducting oxide ($AO_x$) used in the present invention can be configured from the conducting oxides ($AO_x$) having a minimized value of about (+)500 ppm/K to about (−)500 ppm/K.

In some embodiments, a nonconducting oxide ($BO_y$) of the present invention comprises a binary oxide such as, but not limited to, $AlO_y$, $TiO_y$, $TaO_y$, $HfO_y$, $BaO_y$, $VO_y$, $MoO_y$, $SrO_y$, $NbO_y$, $MgO_y$, $SiO_y$, $FeO_y$, $CrO_y$, $NiO_y$, $CuO_y$, $ZrO_y$, $BO_y$, $TeO_y$, $ZnO_y$, $BiO_y$, $WO_y$, $CdO_y$, $CoO_y$, $LaO_y$, $MgO_y$, $GaO_y$, $GeO_y$, and the like. In some embodiments, a nonconducting oxide ($BO_y$) of the present invention comprises a ternary or multi-element oxide such as, but not limited to, $SrTiO_3$, $BaTiO_3$, $Al_xTi_{1-x}O_y$, $Hf_xSi_{1-x}O_y$, $Hf_xAl_{1-x}O_y$, $Hf_xAl_{1-x}O_y$, $Ti_xSi_{1-x}O_y$, $Ta_xSi_{1-x}O_y$, $LaTiO_3$ and $Zn_xTi_{1-x}O_y$. Furthermore, the mixture of at least two kinds of materials can configure the nonconducting oxide ($BO_y$). That is, the nonconducting oxide ($BO_y$) in the present invention refers to mixtures of at least two kinds of a nonconducting metal or a nonmetal oxide including a single or multi-element oxides with an electrical conductivity shown as above.

The heating resistor of the present invention has a resistivity of about 10 μΩ·cm to about 30,000 μΩ·cm, about 100 μΩ·cm to about 30,000 μΩ·cm, about 100 μΩ·cm to about 20,000 μΩ·cm, about 100 μΩ·cm to about 10,000 μΩ·cm, about 100 μΩ·cm to about 5,000 μΩ·cm, about 100 μΩ·cm to about 2,500 μΩ·cm, about 100 μΩ·cm to about 1,000 μΩ·cm, or about 100 μΩ·cm to about 500 μΩ·cm.

In order to form a heating resistor with new materials according to the present invention, generally expressional physical vapor deposition (PVD) methods including a sputtering method and an electronic-beam vapor deposition method and generally expressional chemical vapor deposition (CVD) methods including an atomic layer deposition (ALD) method or a plasma enhanced atomic layer deposition (PE-ALD) method can be used but these methods are not only methods for forming a heating resistor with new materials according to the present invention. For example, a sol-gel method and an electroplating method can be used besides the above-mentioned methods. In other words, the methods for forming new materials of the heating resistor according to the present invention mentioned in the present invention are not limited as the only methods for forming new materials according to the present invention.

It is preferable that the heating resistor according to the present invention have the thickness of about 20 Å to about 20,000 Å, about 20 Å to about 5,000 Å, about 20 Å to about 1,000 Å, about 20 Å to about 500 Å, about 20 Å to about 200 Å, or about 20 Å to about 100 Å.

In some embodiments, a heating resistor can comprise a mixture of a conducting and nonconducting oxide such as $(RuO_x)_m$—$(TiO_y)_n$, wherein $RuO_x$ is a conducting oxide and $TiO_y$ is a nonconducting oxide.

Figure 3:
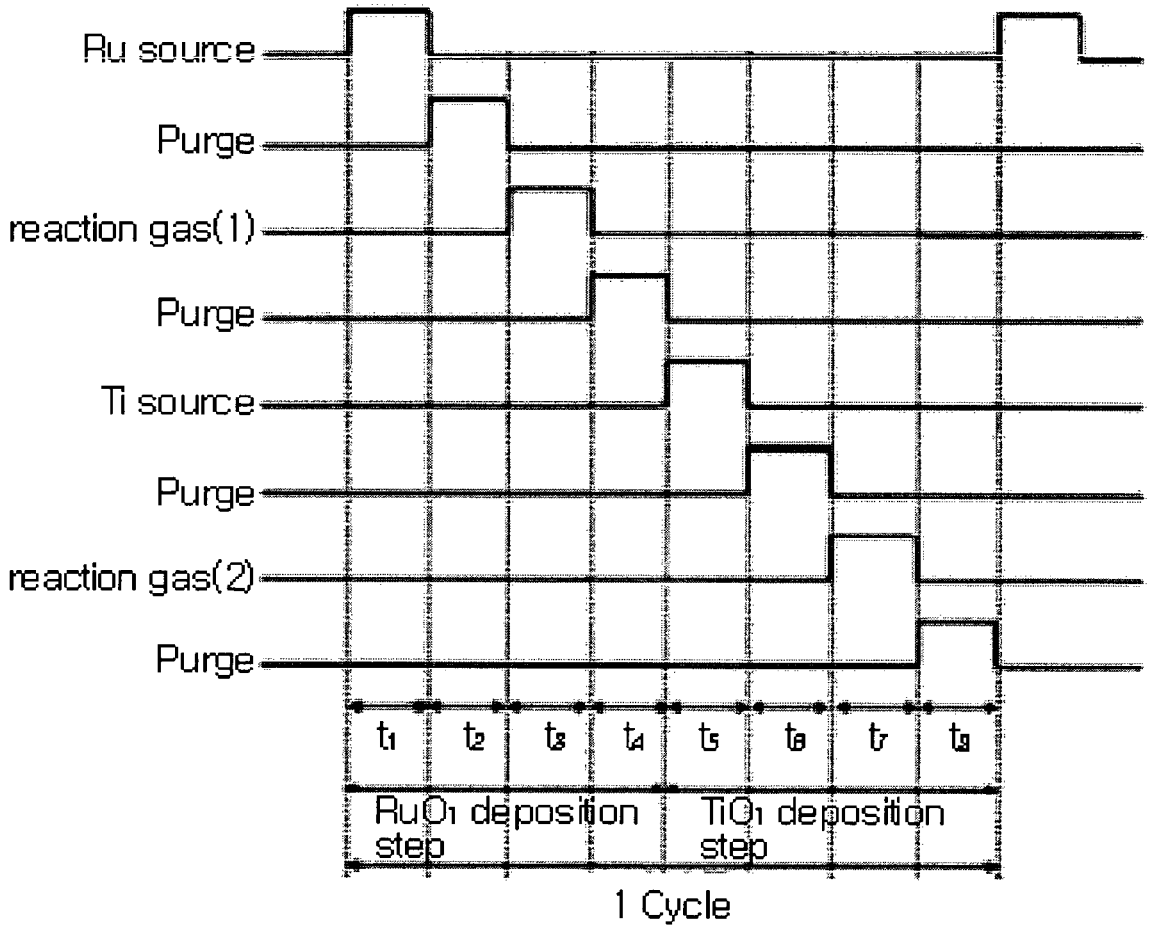
FIG. 3 is a schematic representation of a process suitable for forming a heating resistor comprising a conductive oxide ($AO_x$) and a nonconductive oxide ($BO_y$) via an atomic layer deposition process.

FIG. 3 is a schematic representation of the process steps suitable depositing a material for use as a heating resistor of the present invention. For example, an $(RuO_x)_m$—$(TiO_y)_n$ material of the present invention can be deposited via an atomic layer deposition process, the process comprising: (a) injecting into a reaction chamber a precursor comprising an Ru source, wherein the precursor chemically adsorbs to a substrate located within the reaction chamber; (b) injecting a purge gas; (c) injecting a reaction gas (1) to remove or oxidize a ligand of the precursor chemically adsorbed to the substrate, thereby forming a conducting oxide ($AO_x$ or $RuO_x$); (d) injecting a purge gas; and (e) injecting a second precursor comprising a Ti source, wherein the second precursor adsorbs to the substrate; (f) injecting a purge gas; (g) injecting a second reaction gas (2) to remove or oxidize a ligand of the second precursor chemically adsorbed to the substrate, thereby forming nonconducting oxide ($BO_y$ or $TiO_y$); and (h) injecting a purge gas to form a $(RuO_x)_m$—$(TiO_y)_n$ material with a regular thickness. Repeating this cycle results in a thin film, the thickness of which is proportional to the number of cycles that the process is repeated. Therefore, a thin film with a desired thickness can be formed on a substrate. In addition, the mixing ratio of $RuO_x$ and $TiO_y$ in the $(RuO_x)_m$—$(TiO_y)_n$ material can be controlled by selectively repeating (a)-(d), or (e)-(h) as a single cycle, resulting in multiple deposition layers of the conducting oxide or the nonconducting oxide.

In a similar manner to the process outlined in FIG. 3, other conducting oxides ($AO_x$) and nonconducting oxides ($BO_y$)

exemplified in Table 1 can be deposited in an analogous manner. As described above, various combinations formed by mixing "conducting oxides" ($AO_x$) and "nonconducting oxides" can be obtained. Moreover, as described above, the method for depositing an atomic layer in accordance with the present invention is not limited to atomic layer deposition processes. Thin films for use in heating resistors can also be deposited by other known thin film deposition processes such as, but not limited to, PVC, CVD, and the like.

Figure 4:
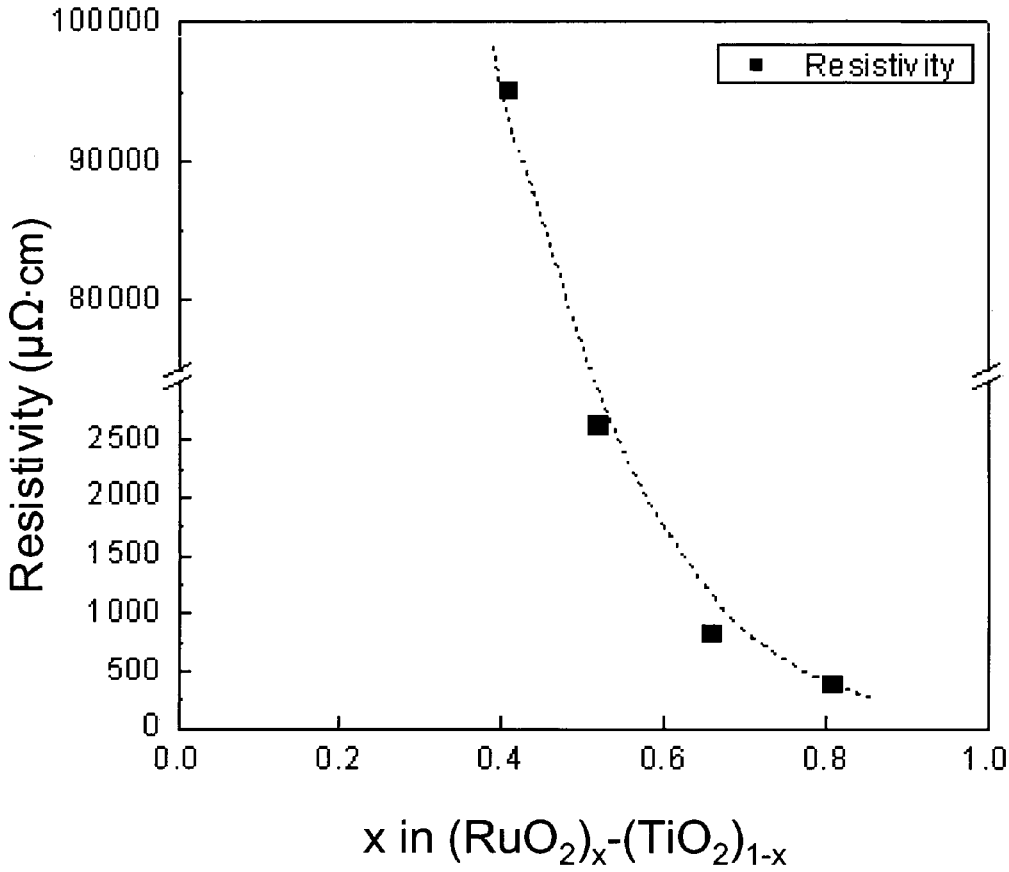
FIG. 4 is a graph showing the change in resistivity in accordance with the change in the stoichiometric composition of a $(RuO_x)_m$—$(TiO_y)_n$ material formed in accordance with an embodiment of the present invention.

The resistivity of a material suitable for use as a heating resistor can be modified in a regular manner in accordance with the present invention by modifying the concentration of the conducting and nonconducting oxide portions present in the material. For example, FIG. 4 illustrates the increase in resistivity of an oxide material comprised of $(RuO_x)_m$—$(TiO_y)_n$ as the relative concentration of the $(RuO_2)_x$ oxide is decreased. FIG. 4 illustrates that the resistivity of an $(RuO_x)_m$—$(TiO_y)_n$ material can be controlled in a broad range from about 350 μΩ·cm to about 95,000 μΩ·cm as the stoichiometric concentration of $(RuO_2)_x$ is varied from about 40% to about 80%. Increasing the stoichiometric concentration of $(RuO_2)_x$ above 80% will result in a material having a resistivity even less than about 350 μΩ·cm.

Figure 5:
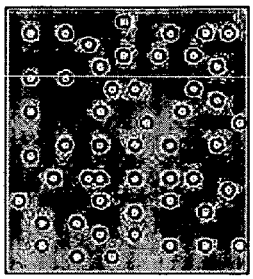
FIG. 5 is a schematic representation of the mixing structure of a material comprising a conductive oxide ($AO_x$) and a nonconductive oxide ($BO_y$) material formed in accordance with an embodiment of the present invention.
Figure 5:
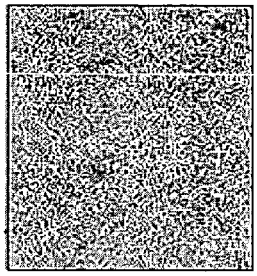
Figure 5:
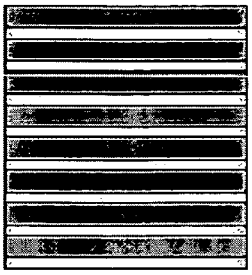

In addition to controlling the relative amount of conducting and nonconducting oxide present in the heating resistor, the structure of the heating resistor can also be modified. Three possible structures for the oxide materials present in the heating resistor are illustrated schematically in FIG. 5. In some embodiments, the heating resistor has a structure wherein the conducting oxide ($AO_x$) is present as a matrix and the nonconducting oxide ($BO_y$) is present as particles embedded in the matrix (e.g., the "Nano-Crystal Embedded Structure" depicted in FIG. 5). In some embodiments, the heating resistor has a structure wherein the conducting oxide ($AO_x$) is completely mixed with the nonconducting oxide ($BO_y$) so that the conducting oxide and the nonconducting oxide cannot be distinguished (e.g., "Inter-mixed Structure"). In some embodiments, the heating resistor has a structure wherein the conducting oxide ($AO_x$) and the nonconducting oxide ($BO_y$) are present as a layered structure (e.g., a "Laminated Structure"). In some embodiments, the heating resistor has a structure that comprises a combination of two or more of the above-mentioned structures.

Figure 6:
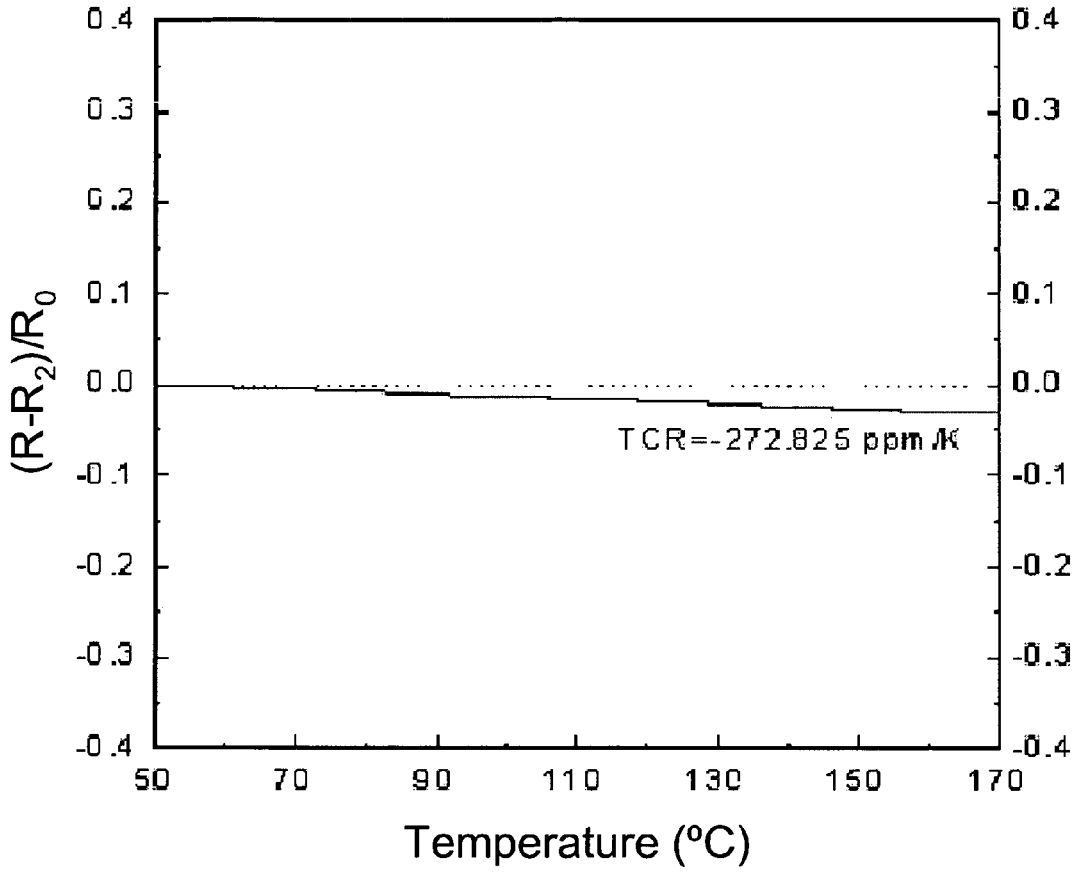
FIG. 6 is a graph showing characteristics of the temperature coefficient of a resistance of a $(RuO_x)_m$—$(TiO_y)_n$ material formed in accordance with an embodiment of the present invention.

FIG. 6 shows the characteristics of temperature coefficient of a resistance of a $(RuO_x)_m$—$(TiO_y)_n$ material formed in accordance with an embodiment of the present invention. The $(RuO_x)_m$—$(TiO_y)_n$ material of the present invention has a TCR of about −272.8 ppm/K. Moreover, the $(RuO_x)_m$—$(TiO_y)_n$ material exhibits a minimal change in resistance between the temperatures 50° C. and 170° C. The TCR should be minimized so that a liquid ejecting system with a stable dispensing characteristic in the range of the used temperature can be formed for the reason why the TCR characteristics of a RuOx conducting oxide layer constituting the $(RuO_x)_m$—$(TiO_y)_n$ material formed in accordance with the embodiment of the present invention have a small value close to "0" as disclosed in Jia, Q. X. et al., "On the nature of zero temperature coefficient of resistance of $RuO_2$ thin film resistor formation using in situ annealing," *J Vac Sci Tech: A* 11:1052-1055 (1993) and Kim, Y. T., "Achievement of zero temperature coefficient of resistance with $RuO_x$ thin film resistors," *Appl Phys Lett* 70:209-211 (1997).

In some embodiments, the TCR value of the heating resistor can be minimized by selecting a conductive oxide from the group consisting of: $RuO_x$, $IrO_x$, $RhO_x$, $PdO_x$, $BiRuO_x$, and combinations thereof. Furthermore, the TCR value of heating resistor can also be influenced by the nonconducting oxide ($BO_y$), and materials for use as nonconducting oxides with the heating resistor of the present invention. In addition to exhibiting low thermal expansion, chemical and mechanical impact-resistance, and electrical insulating characteristics, the nonconducting oxide should not form a complex or a eutectic composition with the conducting oxide ($AO_x$),.

The heating resistor of the present invention is suitable for use in liquid ejecting systems, and other printing devices in which a printing liquid is ejected from a reservoir based upon the application of thermal energy to the printing liquid.

Figure 2:
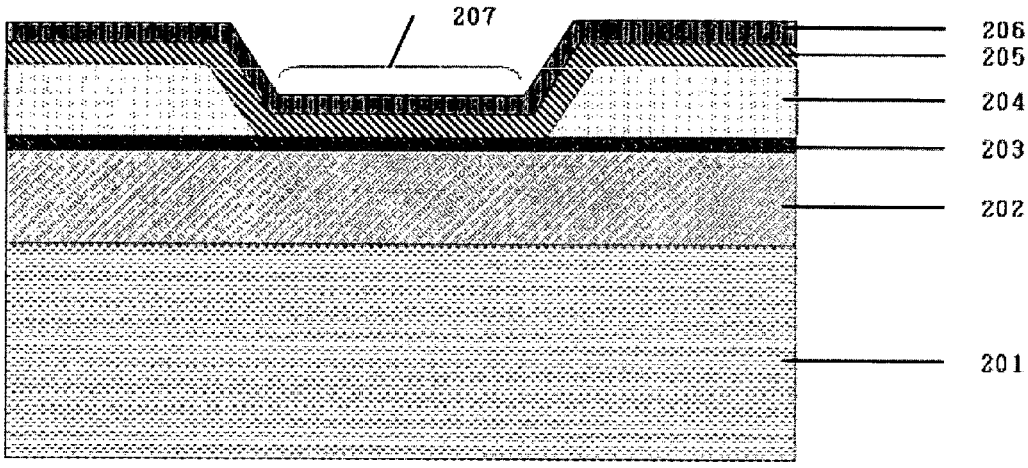
FIG. 2 is a schematic cross-sectional view for describing the major parts of the conventional substrate for liquid ejecting head in detail.

The new materials according to the present invention have good mechanical impact resistance and chemical stability to oxidation and corrosion. Therefore, a heating resistor of the present invention does not require a protection layer or layers (205, 206), as shown in FIG. 2, or in some embodiments the thickness of these layers can be minimized. Typical protection layers (205, 206) include materials having low thermal conductivity such as: silicon nitride ($SiN_x$), silicon carbide ($SiC_x$), BPSG, silicon oxide ($SiO_x$), and combinations thereof. The superb stability of the oxide materials of the present invention permit the thickness of a protection layer to be diminished or removed entirely, thereby bringing the printing liquid in direct contact with the heating resistor and improving the thermal efficiency of the device. Accordingly, it is possible to manufacture a high efficiency liquid ejecting system capable of driving the liquid ejecting head with low power. Therefore, the embodiments now will be described in order to provide with a liquid ejecting system having a heating resistor formed of the new material according to the present invention and a part or the entire of the protection layer is removed.

Figure 7:
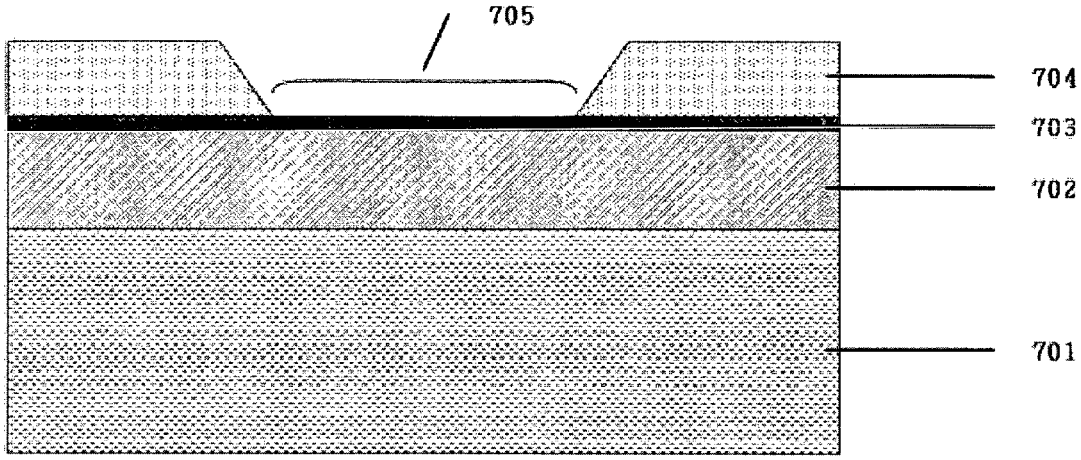
FIG. 7 and FIG. 8 are schematic cross-sectional views of a substrate for use with a liquid ejecting head, wherein the substrate lacks a protection layer in accordance with an embodiment of the present invention.
Figure 8:
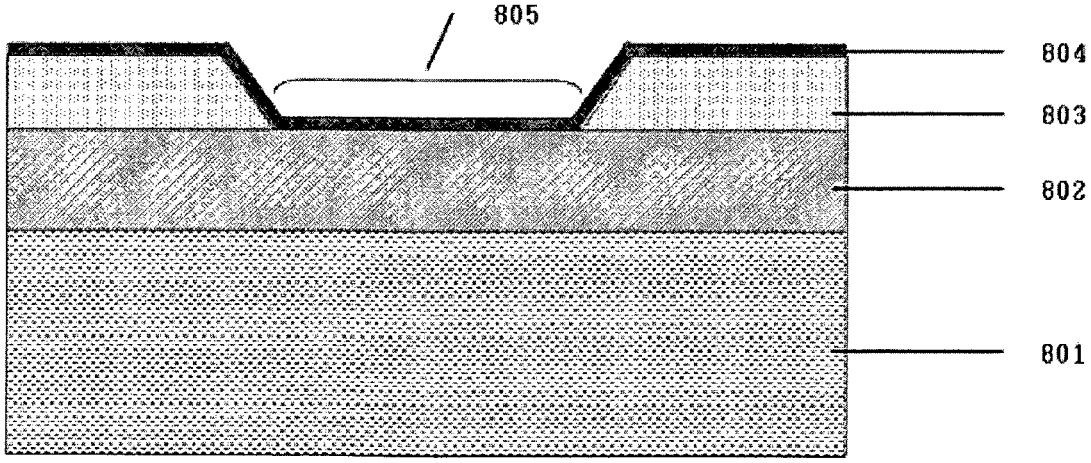

FIG. 7 and FIG. 8 are cross-sectional views for schematically showing a substrate for a liquid ejecting head from which a part or the entire of the protection layer is removed in order to provide with a liquid ejecting system from which a part or the entire of the protection layer is removed. The substrate for liquid ejecting head shown in FIG. 7 has a structure where a plurality of material layers including a silicon substrate layer (701) with a driving circuit in general and a heating resistor (703) formed on the silicon substrate layer are stacked. For more detail, an insulating layer (702) for thermal and electrical insulation between the heating resistor (703) formed of the new material according to the present invention and the silicon substrate layer (701) is formed on the silicon substrate layer (701) and a heating resistor (703) comprising a new material according to the present invention is formed on the insulating layer (702). An electrode layer (704) comprising a metal conductor material is formed on the heating resistor (703) in order to apply an electric signal to the heating resistor (703). A structure where a protection layer is selectively formed between the electrode layer and the liquid for printing in order to protect the electrode layer (704) from the liquid for printing is also possible, even not shown in FIG. 7.

FIG. 8 shows another embodiment of a substrate for liquid ejecting head from which a part or the entire of the above-mentioned protection layer is removed and it has a structure where a plurality of material layers including a silicon substrate layer (801) with a driving circuit in general and a heating resistor (804) formed on the silicon substrate layer. For more detail, an insulating layer (802) for thermal and electrical insulation between the heating resistor (804) formed of the new material according to the present invention and the silicon substrate layer (801) is formed on the silicon substrate layer (801), an electrode layer (803) comprising a metal conductor material for applying an electrical signal to the heating resistor (804) is formed on the insulating layer (802) and a heating resistor (804) comprising a new material according to the present invention is formed on the electrode layer (803).

As shown in FIG. 7 and FIG. 8, the substrate for liquid ejecting head from which a part or the entire of the protection layer is removed is characterized by that the liquid for printing directly contacts with the heating resistors (703, 804) comprising the new material according to the present invention. However, the substrate for liquid ejecting head from which a part or the entire of the protection layer in the present invention is removed is not limited to the specific structure shown in FIG. 7 and FIG. 8 but refers to a substrate for liquid ejecting head with various structures characterized in that a heating resistor comprising the new materials according to the present invention directly contacts with a liquid for printing, in general. For example, as described above, even if a protection layer is selectively formed on the electrode layer (704) so that the electrode layer (704) does not contact with the liquid for printing with maintaining the structure of FIG. 7, it is apparent that a heating resistor directly contacting with the liquid for printing is included in claiming the present invention.

In addition, it is apparent that the liquid ejecting system having a heating resistor comprising new materials according to the present invention is not limited to the specific structure like a substrate for the conventional liquid ejecting head shown in FIG. 2 and a substrate for liquid ejecting head from which a part or the entire of the protection layer is removed in FIG. 7 and FIG. 8 and that a liquid ejecting system having a heating resistor comprising the new material according to the present invention is included in claiming the present invention.

During thermal cycling of a heating resistor an oxide can be formed at the interface between the heating resistor and an electrode. Oxidation of this interface will increase the electrical contact resistance between the heating resistor and the electrode, resulting in decreased device performance. To prevent this oxidation, a contact layer can be deposited between the heating resistor and the electrode. In some embodiments, the contact layer acts by preventing oxidation of the electrode material. Materials suitable for use as a contact layer between the heating resistor and the electrode include, but are not limited to, metals, unreactive metal nitrides, and combinations thereof. In some embodiments, a contact layer comprises a material selected from the group consisting of: an elemental material (A) present in the conducting oxide ($AO_x$), a nitride of an elemental material (A) present in the conducting oxide ($AO_x$), an elemental material (A) present in the conducting oxide ($AO_x$) in combination with at least one of Ti, TiN, Ta, TaN, W, WN and WCN, and combinations thereof.

In some embodiments, Aluminum (Al) is used as an electrode material, and the heating resistor comprises a $(RuO_x)_m$—$(TiO_y)_n$ material according to the embodiment of the present invention. Aluminum electrodes are highly reactive towards oxygen, and an insulating material like $Al_2O_3$ is easily formed at an interface of an Al electrode material and the $(RuO_x)_m$—$(TiO_y)_n$ heating resistor. However, early in the lifetime of the liquid ejecting head an $Al_2O_3$ layer may not have fully formed over the entire surface of the Al electrode. Therefore, to prevent the Al electrode material from being directly contacted with the $(RuO_x)_m$—$(TiO_y)_n$ heating resistor, a contact layer can be deposited to separate the electrode from the heating resistor. In some embodiments, the contact layer comprises: pure Ru metal, an alloy comprising Ru in combination with at least one of Ti, TiN, Ta, TaN, W, WN, or WCN, and combinations thereof.

As described above, according to the present invention, if a new material formed by mixing the conducting oxide with the nonconducting oxide is used, it is possible to provide with a heating resistor having a good heating capability and a longer life along with the reliability, where the change of the electrical resistance in accordance with a temperature in the temperature interval of heating is minimized within a regular range, chemical and mechanical characteristics including electrical characteristics are safely maintained in spite of a repeated used for a long time. In addition, the liquid ejecting system having a heating resistor comprising a new material according to the present invention can maintain the characteristics safe, even if the thickness of a protection layer for protecting the heating resistor is minimized or even if a part or the entire of the protection layer is removed to make the liquid for printing directly contact with the heating resistor, and therefore, a high efficient liquid ejecting system which can be driven with a low power is easily manufactured.

EXAMPLES

A plurality of liquid ejecting systems having the structure shown in FIG. 7 (without the structure of the conventional substrate for liquid ejecting head as shown in FIG. 2) were manufactured, and Step Stress Test (SST), Bubble Test (BT) and Printing Durability (PD) were carried out. The heating resistor was formed using a $(RuO_x)_m$—$(TiO_y)_n$ material manufactured in accordance with the present invention, wherein the surface area of the heating resistor available for heating (705) was about 674 $\mu m^2$ and the resistivity of the $(RuO_x)_m$—$(TiO_y)_n$ material was 108 $\mu\Omega\cdot cm$.

Figure 9:
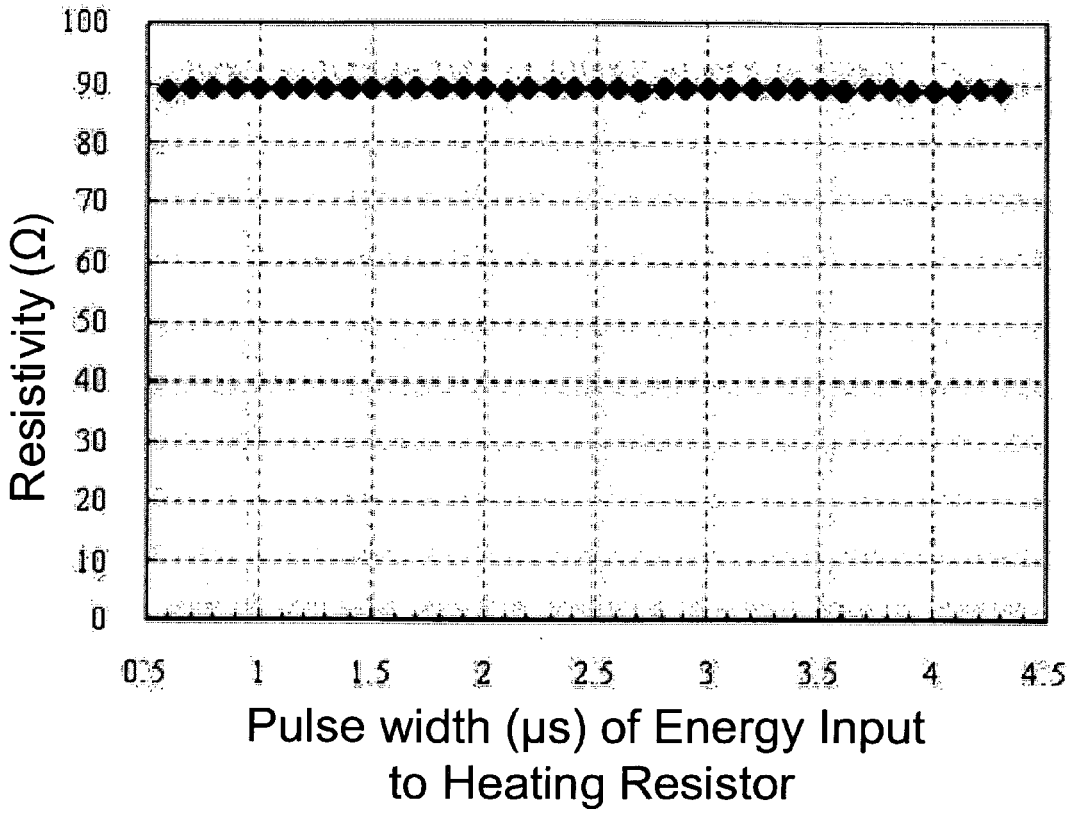
FIG. 9 is a graph showing the result of a Step Stress Test (SST) test performed on a liquid ejecting system comprising a heating resistor comprising a $(RuO_x)_m$—$(TiO_y)_n$ material in accordance with an embodiment of the present invention.

FIG. 9 shows the result of an SST test carried out on the liquid ejecting system of the present invention. The SST test was performed as follows: the electrical resistance of the heating resistor was measured continuously while an energy pulse was applied to the heating resistor beginning at a pulse width of 0.5 μsec and increasing in increments of 0.1 μsec up to a pulse width of 4.5 μsec at a frequency of 12 kHz, a driving voltage of 1.4 $GW/m^2$, for a duration of one second. With reference to FIG. 9, even when the pulse width of the applied energy pulse is increased, the resistivity of the heating resistor comprising the $(RuO_x)_m$—$(TiO_y)_n$ material of the present invention is nearly constant. In other words, when a heating resistor comprising an oxide material of the present invention is used in a liquid ejection device and the energy [(driving voltage)×(time)] applied to the heating resistor is increased, the resistance of the heating resistor is constant even when the temperature of the heating resistor increases. Therefore, it is possible to manufacture a reliable liquid ejecting system capable of safely maintaining the electrical characteristics over a wide range of operating conditions.

In addition, with respect to the liquid ejecting system having a heating resistor comprising the $(RuO_x)_m$—$(TiO_y)_n$ material formed by the preferred embodiment, the BT test was performed in the conditions as follows: a driving voltage for ejecting a liquid is fixed to 7 V, the width of energy pulse to 0.76 μsec, the driving frequency of the applied electric signal to 12 kHz, and a liquid is continuously ejected to the point of device failure. The results of this test indicate that a printing liquid can be safely ejected from a liquid ejecting head of the present invention an average of $4.5\times10^7$ times before device failure occurs.

Additionally, a liquid ejecting system having a conventional structure shown in FIG. 2 requires an applied driving voltage per unit area ($m^2$) of approximately 4 GW to 5 GW for device operation (i.e., liquid ejection). Conversely, a liquid ejecting system comprising a heating resistor of the present invention can safely and reproducibly eject a liquid at an applied driving voltage per unit area ($m^2$) of 1.2 GW. Therefore, the heating resistors of the present invention permit a lower driving power to be used in a printing device.

In other words, from the above results according to the above embodiments, if a heating resistor comprising the new material according to the present invention is used, the chemical and mechanical characteristics including electrical characteristics can be safely maintained even if a part or the entire of a protection layer is removed or the thickness of the protection layer is minimized, but also the liquid ejecting system can be driven with a low power.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

All documents cited herein, including journal articles or abstracts, published or corresponding U.S. or foreign patent applications, issued or foreign patents, or any other documents, are each entirely incorporated by reference herein, including all data, tables, figures, and text presented in the cited documents.

What is claimed is:

1. A heating resistor comprising a conducting oxide ($AO_x$) having an electric conductivity and a nonconducting oxide ($BO_y$) having insulation or nonconductivity, wherein the conducting oxide ($AO_x$) has a temperature coefficient of a resistance (TCR) of about (+)500 ppm/K to (−)500 ppm/K.

2. The heating resistor of claim 1, wherein the conducting oxide ($AO_x$) comprises at least one material selected from the group consisting of: $RuO_x$, $PdO_x$, $IrO_x$, $PtO_x$, $OsO_x$, $RhO_x$, $ReO_x$, $ZnO_x$, $InO_x$, $SnO_x$, $PtRhO_x$, $SrRuO_3$, $In_{1-x}Sn_xO_3$, $Na_xW_{1-x}O_3$, $Zn_x(Al,Mn)_{1-x}O$, $La_{0.5}Sr_{0.5}CoO_3$, $CrSiO_x$, $Na_2Pt_3O_4$, $NiCrO_x$, $Bi_2Ru_2O_7$.

3. The heating resistor of claim 1, wherein the nonconducting oxide (BOy) comprises at least one material selected from the group consisting of: $AlO_y$, $TiO_y$, $TaO_y$, $HfO_y$, $BaO_y$, $VO_y$, $MoO_y$, $SrO_y$, $NbO_y$, $MgO_y$, $SiO_y$, $FeO_y$, $CrO_y$, $NiO_y$, $CuO_y$, $ZrO_y$, $BO_Y$, $TeO_y$, $ZnO_y$, $BiO_y$, $WO_y$, $CdO_y$, $CoO_y$, $LaO_y$, $MgO_y$, $GaO_y$, $GeO_y$, $SrTiO_3$, $BaTiO_3$, $Al_xTi_{1-x}O_y$, $Hf_xSi_{1-x}O_y$, $HfxAl_{1-x}O_y$, $Hf_xAl_{1-x}O_y$, $Ti_xSi_{1-x}O_y$, $Ta_xSi_{1-x}O_y$, $LaTiO_3$, $ZnxTi_{1-x}O_y$.

4. The heating resistor of claim 1, wherein the heating resistor has a temperature coefficient of resistance (TCR) of about (+)500 ppm/K to (−)500 ppm/K.

5. The heating resistor of claim 1, wherein the heating resistor has a resistivity of about 10 μΩ·cm to about 30,000 μΩ·cm and a thickness of about 20 Å to about 20,000 Å.

6. The heating resistor of claim 1, wherein the heating resistor has a structure selected from the group consisting of: a structure wherein the conducting oxide ($AO_x$) is present as a matrix and the nonconducting oxide ($BO_y$) is present as particles embedded in the matrix; a structure wherein the conducting oxide ($AO_x$) is completely mixed with the nonconducting oxide ($BO_y$) so that the conducting oxide and the nonconducting oxide cannot be distinguished; a structure wherein the conducting oxide ($AO_x$) and the nonconducting oxide ($BO_y$) are present as a layered structure; and combinations thereof.

7. A substrate for a liquid ejecting head comprising:

(a) a silicon substrate layer;

(b) a heating resistor deposited thereon, wherein the heating resistor comprises a conducting oxide ($AO_x$) having an electric conductivity and a nonconducting oxide ($BO_y$) having insulation or nonconductivity, wherein the heating resistor is capable of generating a thermal energy in response to an electric signal, and wherein the conducting oxide ($AO_x$) has a temperature coefficient of a resistance (TCR) of about (+)500 ppm/K to (−)500 ppm/K; and (c) an electrode layer suitable for supplying an electric signal to the heating resistor.

8. The substrate for a liquid ejecting head of claim 7, further comprising: a contact layer located between the heating resistor and the electrode layer, wherein the contact layer comprises a material selected from the group consisting of: an elemental material (A) present in the conducting oxide (AOx), a nitride of an elemental material (A) present in the conducting oxide (AOx), an elemental material (A) present in the conducting oxide (AOx) in combination with at least one of Ti, TiN, Ta, TaN, W, WN and WCN, and combinations thereof.

9. The substrate for a liquid ejecting head of claim 7, further comprising: a single or multilayered protection layer suitable for protecting the electrode layer and the heating resistor.

10. The substrate for a liquid ejecting head of claim 9, further comprising: a contact layer located between the heating resistor and the electrode layer, wherein the contact layer comprises a material selected from the group consisting of: an elemental material (A) present in the conducting oxide (AOx), a nitride of an elemental material (A) present in the conducting oxide (AOx), an elemental material (A) present in the conducting oxide (AOx) in combination with at least one of Ti, TiN, Ta, TaN, W, WN and WCN, and combinations thereof.

11. A liquid ejecting head comprising:

the substrate of claim 7, 8, 9 or 10;

a liquid ejecting head provided on the substrate; and a liquid supply passage disposed on the substrate suitable for supplying a liquid to the to the liquid ejecting head.

12. A liquid ejecting apparatus comprising:

the substrate of claim 7, 8, 9 or 10;

a liquid ejecting head provided on the substrate;

a liquid supply passage disposed on the substrate suitable for supplying a liquid to the to the liquid ejecting head; and an electrical signal supply means suitable for supplying an electric signal to the heating resistor.

* * * * *